US010695269B2

(12) United States Patent
Besser et al.

(10) Patent No.: US 10,695,269 B2
(45) Date of Patent: Jun. 30, 2020

(54) NASOGASTRIC TUBE

(71) Applicant: ENVIZION MEDICAL LTD., Tel Aviv (IL)

(72) Inventors: Doron Besser, Tel Aviv (IL); Guy Ben Ezra, Karkur (IL)

(73) Assignee: ENVIZION MEDICAL LTD., Tel Aviv (IL)

( * ) Notice: Subject to any disclaimer, the term of this patent is extended or adjusted under 35 U.S.C. 154(b) by 0 days.

(21) Appl. No.: 15/503,638

(22) PCT Filed: Aug. 14, 2014

(86) PCT No.: PCT/IL2014/050736

§ 371 (c)(1),
(2) Date: Feb. 13, 2017

(87) PCT Pub. No.: WO2016/024260

PCT Pub. Date: Feb. 18, 2016

(65) Prior Publication Data

US 2017/0258688 A1 Sep. 14, 2017

(51) Int. Cl.
*A61J 15/00* (2006.01)

(52) U.S. Cl.
CPC ..... *A61J 15/003* (2013.01); *A61J 15/0003* (2013.01); *A61J 15/0073* (2013.01); *A61J 15/0092* (2013.01)

(58) Field of Classification Search
CPC .. A61J 15/003; A61J 15/0073; A61J 15/0092; A61M 2025/0034; A61M 2025/0035; A61M 2025/0036; A61M 2025/004; A61M 2025/0039; A61M 25/0015; A61M 2025/018
See application file for complete search history.

(56) References Cited

U.S. PATENT DOCUMENTS 4,356,824 A 11/1982 Vazquez
4,904,238 A * 2/1990 Williams ..... A61M 1/0084 604/264
4,968,307 A * 11/1990 Dake ..... A61M 25/007 604/264
5,389,074 A 2/1995 Parker et al.
5,707,351 A 1/1998 Dorsey, III
(Continued)

FOREIGN PATENT DOCUMENTS

EP 2301512 3/2011
WO 2003034976 5/2003
(Continued)

OTHER PUBLICATIONS

International Search Report for PCT/IL2014/050736 completed Dec. 8, 2014; dated Dec. 14, 2014 4 Pages.
(Continued)

*Primary Examiner* — Manuel A Mendez
*Assistant Examiner* — Courtney B Fredrickson
(74) *Attorney, Agent, or Firm* — The Roy Gross Law Firm, LLC; Roy Gross

(57) ABSTRACT

A nasogastric tube comprising at least one main lumen and at least one vacuum lumen comprising at least one suction port for sealingly drawing an inner wall of an esophagus thereagainst, said at least one suction port has a unique concave structure which substantially prevents tissue damage is provided.

19 Claims, 7 Drawing Sheets

(56) References Cited

U.S. PATENT DOCUMENTS

| | | | | |
|---|---|---|---|---|
| 6,126,647 | A | 10/2000 | Posey et al. | |
| 6,165,164 | A | 12/2000 | Hill et al. | |
| 6,695,764 | B2 | 2/2004 | Silverman et al. | |
| 6,790,214 | B2 | 9/2004 | Kraemer et al. | |
| 6,949,092 | B1 | 9/2005 | Moss | |
| 7,794,425 | B2 | 9/2010 | Gobel | |
| 7,967,780 | B2 | 6/2011 | Goebel | |
| 8,100,874 | B1 | 1/2012 | Jordan et al. | |
| 8,453,648 | B2 | 6/2013 | Black et al. | |
| 2003/0208209 | A1 | 11/2003 | Gambale et al. | |
| 2004/0082909 | A1 | 4/2004 | Shia et al. | |
| 2004/0153098 | A1* | 8/2004 | Chin | A61B 17/00008 606/129 |
| 2004/0220515 | A1 | 11/2004 | Constantz | |
| 2005/0059962 | A1 | 3/2005 | Phan et al. | |
| 2005/0137574 | A1* | 6/2005 | Sakal | A61B 10/0041 604/514 |
| 2008/0077043 | A1* | 3/2008 | Malbrain | A61B 5/036 600/547 |
| 2008/0195047 | A1 | 8/2008 | Price | |
| 2009/0069796 | A1 | 3/2009 | Oskin | |
| 2009/0306626 | A1 | 12/2009 | Sinha et al. | |
| 2009/0317760 | A1 | 12/2009 | Gadbois | |
| 2010/0030133 | A1 | 2/2010 | Elia et al. | |
| 2011/0046653 | A1 | 2/2011 | Addington et al. | |
| 2011/0130650 | A1* | 6/2011 | Dayan | A61J 15/0003 600/424 |
| 2012/0150111 | A1 | 6/2012 | Hershey et al. | |
| 2013/0158471 | A1 | 6/2013 | Neel et al. | |
| 2013/0310806 | A1 | 11/2013 | Nevler et al. | |
| 2014/0066880 | A1 | 3/2014 | Prince et al. | |
| 2014/0088359 | A1 | 3/2014 | Quaye | |
| 2014/0100531 | A1* | 4/2014 | Ankrum | A61M 1/0084 604/181 |
| 2014/0188080 | A1 | 7/2014 | Besser et al. | |
| 2014/0235960 | A1 | 8/2014 | Addington et al. | |
| 2015/0174013 | A1 | 6/2015 | Besser et al. | |

FOREIGN PATENT DOCUMENTS

| | | | | |
|---|---|---|---|---|
| WO | 2007095541 | | 8/2007 | |
| WO | WO 2013/012774 | A1 * | 1/2013 | A61J 15/00 |
| WO | 2015198297 | | 11/2015 | |

OTHER PUBLICATIONS

Written Opinion for PCT/IL2014/050736 completed Dec. 8, 2014; dated Dec. 14, 2014 5 Pages.

* cited by examiner 50
28
26a
16b
I
II
26b
23
16a
16f
26f
16c
12
16d
16e
26c
26e
26d
16a
26a

NASOGASTRIC TUBE

This application is a 35 U.S.C. § 371 national phase application of PCT/IL2014/050736 filed Aug. 14, 2014. This application is incorporated herein by reference as if fully set forth.

FIELD OF THE INVENTION

The present invention relates generally to nasogastric tubes.

BACKGROUND OF THE INVENTION

Enteral feeding is a form of hyperalimentation and metabolic support in which nutrient formulas or medicaments are delivered directly to the GI tract, either to the stomach or the duodenum. A nasogastric tube (NGT) is used for feeding and administering drugs and other oral agents. The tube is inserted into the patient's esophagus and stomach in order to ensure the passage of the agents into the stomach and not into the lungs. The NGT can also be used for suction of fluids from the stomach.

However, the use of NGTs can have disadvantages. Minor complications include nose bleeds, sinusitis, and a sore throat. Sometimes more significant complications occur including erosion of the nose where the tube is anchored, esophageal perforation, pulmonary aspiration, a collapsed lung, or intracranial placement of the tube.

Even worse, during feeding, excessive gastric pressure may result. From time to time, the body relieves such excess gastric pressure by expelling gas or liquid or reflux fluid. The fluids are expelled from the stomach through the esophagus to the mouth or nasal pathways. The reflux fluids may be inhaled into the lungs with possible risk of aspiration pneumonia, bacterial infection in the pharynx or esophagus or any other ailments. Accordingly, numerous studies have linked the use of the NGT to an increase in ventilator-associated pneumonia (VAP). VAP is the most common nosocomial infection in the intensive care unit (ICU), and it is associated with prolonged hospitalization, increased health care costs, and high attributable mortality.

US Patent Application Publication No. 2013/0310806 provides a nasogastric tube including a main lumen having one or more proximal connectors for connecting to a source of substances or pressure, and one or more vacuum lumens peripherally surrounding the main lumen, each vacuum lumen including a vacuum sealing portion which includes one or more suction ports for sealingly drawing an inner wall of an esophagus thereagainst. The contents of US 2013/0310806 are incorporated herein by reference in their entirety.

There is a need for improved NGTs having suction ports capable of drawing an inner wall of an esophagus thereagainst without causing tissue damage due to the applied suction force.

SUMMARY OF THE INVENTION

The following embodiments and aspects thereof are described and illustrated in conjunction with systems, tools and methods which are meant to be exemplary and illustrative, not limiting in scope.

There is provided, in accordance with an embodiment, a nasogastric tube comprising at least one vacuum lumen comprising at least one suction port for sealingly drawing an inner wall of an esophagus thereagainst, said at least one suction port has a concavity whose longitudinal cross-section has a shape delimited between (i) a first arc of a first circle, the first arc having a length of 25 millimeters and a height of 1.5 millimeters, and (ii) a second arc of a second circle, the second arc having a length of 15 millimeters and a height of 1 millimeter.

There is provided, in accordance with another embodiment, a system comprising a nasogastric tube comprising: (a) a main lumen having one or more proximal connectors for connecting to a source of substances or pressure; (b) a plurality of vacuum lumens peripherally surrounding said main lumen; and (c) a plurality of suction ports for sealingly drawing an inner wall of an esophagus thereagainst, each of said plurality of suction port is associated with a different one of said plurality of vacuum lumens, wherein each suction port has a concavity whose longitudinal cross-section has a shape delimited between (i) a first arc of a first circle, the first arc having a length of 25 millimeters and a height of 1.5 millimeters, and (ii) a second arc of a second circle, the second arc having a length of 15 millimeters and a height of 1 millimeter.

There is further provided, in accordance with an embodiment, a method comprising introducing a nasogastric tube described herein into an esophagus of a patient; and applying vacuum interchangeably to said four or more vacuum lumens so as to sealingly draw an inner wall of an esophagus thereagainst.

In another embodiment, the one or more vacuum lumens are substantially rectangular shaped. In another embodiment, said one or more vacuum lumens have a width-height aspect ratio of 1:1 to 3:1. In another embodiment, said one or more vacuum lumens have a height of 0.3-0.8 mm. In another embodiment, said one or more vacuum lumens have a width of at most 1.5 mm.

In another embodiment, said nasogastric tube further comprising a main lumen having one or more proximal connectors for connecting to a source of substances or pressure, said at least one vacuum lumen peripherally surrounds said main lumen and said at least one suction port is positioned on a circumference extension of said main lumen.

In another embodiment, said plurality of vacuum lumens comprises at least four vacuum lumens. In another embodiment, said plurality of vacuum lumens comprises at least six vacuum lumens.

In another embodiment, said system further comprises a vacuum source connected to said plurality of vacuum lumens. In another embodiment, said plurality of vacuum lumens are connected to said vacuum source via a pressure regulator and a valve.

In another embodiment, said main lumen and said plurality of vacuum lumens are constructed as one unit. In another embodiment, said plurality of vacuum lumens are a separate unit from said main lumen, and wherein said plurality of vacuum lumens are slidable relative to said main lumen. In another embodiment, said main lumen and said plurality of vacuum lumens are arranged as concentrically arranged conduits.

In another embodiment, said system further comprises one or more auxiliary suction ports proximal to said plurality of suction ports. In another embodiment, said plurality of suction ports is associated with a different one of said plurality of vacuum lumens, wherein said plurality of suction ports are distributed between at least two different locations along a longitudinal axis of said nasogastric tube.

In another embodiment, said system further comprises a manifold configured to connect said plurality of vacuum lumens to said valve. In another embodiment, said manifold is transparent.

In another embodiment, said nasogastric tube further comprises two or more longitudinal radiopaque stripes. In another embodiment, said radiopaque stripes are embedded in an outer wall of said nasogastric tube.

In some embodiments, the method of the invention further comprises regulating the vacuum so that a suction level is not constant over time. In some embodiments, the method further comprises regulating vacuum to said plurality of suction ports of said plurality of vacuum lumen, so as to create peristaltic movement or other oscillatory movement of the esophagus.

In some embodiments, said applying of the vacuum restricts at least 60% of passage through the esophagus.

In some embodiments, the method further comprises visually monitoring a transparent manifold coupling said plurality of vacuum lumens with said valve for backflow of gastric substances.

In addition to the exemplary aspects and embodiments described above, further aspects and embodiments will become apparent by reference to the figures and by study of the following detailed description.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
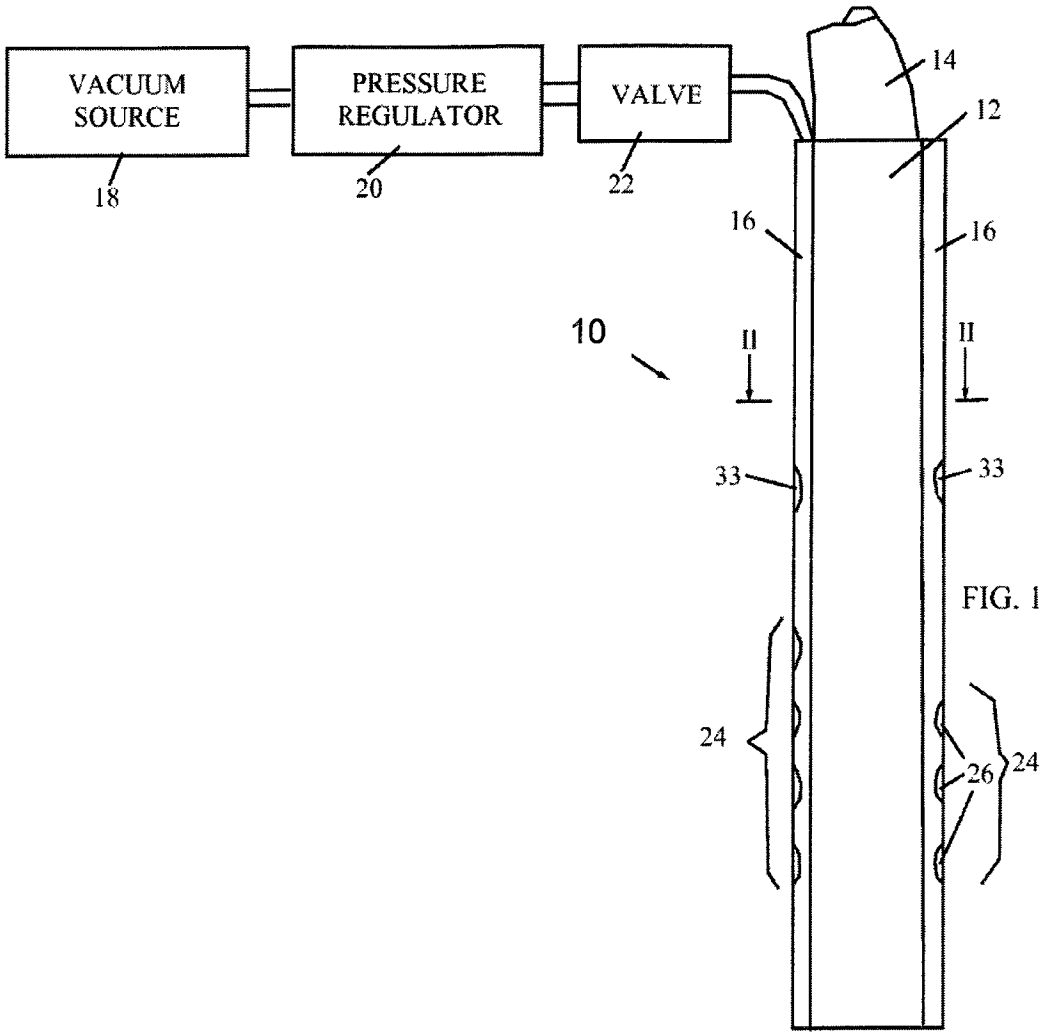
FIG. 1 is a simplified schematic illustration of a nasogastric tube, constructed and operative in accordance with a non-limiting embodiment of the present invention.

The present invention provides a nasogastric tube (NGT) and a method thereof, as is described more in detail hereinbelow. The NGT includes a tube and a vacuum control unit. The vacuum control unit couples the esophagus to the tube thus disabling the reflux of the food along the esophagus to the trachea.

According to the present invention, the inner wall of the esophagus is drawn by negative pressure (vacuum) towards and against the outer contour of the NGT. A vacuum control unit, which is connected to the hospital vacuum unit or any other vacuum unit, enables either simultaneous vacuum pressure in one or more suction units of the NGT or changeable vacuum pressure between the different suction units. In this way, the NGT of the present invention prevents reflux and aspiration of substances or liquids into the patient's lungs and prevents tissue damage, while obviating the need to remove and replace the entire device from the patient's esophagus.

The present invention is based, in part, on finding that a unique structure of the suction unit(s) of said NGT allows the coupling of the esophagus to the tube while preventing the drawing of said tissue into the vacuum lumen, when vacuum force is applied. Thus, the NGT disclosed herein advantageously prevents reflux along the esophagus while refraining from causing tissue damage.

Figure 4A:
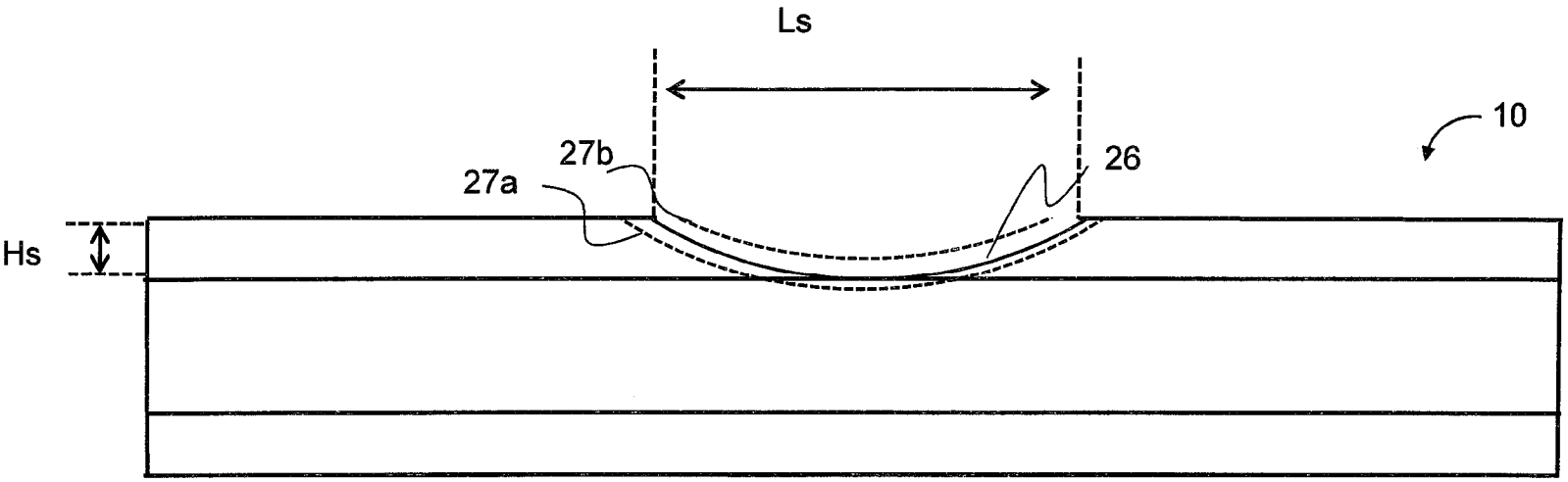
FIG. 4A is a simplified, schematic illustration of a side view of a portion of a nasogastric tube, constructed and operative in accordance with another embodiment of the present invention.
Figure 4B:
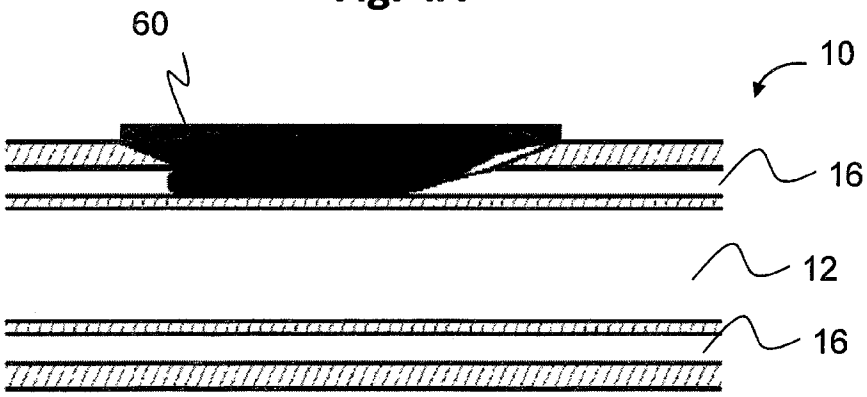
FIG. 4B is a simplified schematic illustration of a transparent side view of a portion of a nasogastric tube, depicting a tissue being drawn into the vacuum lumen.

Reference is made to FIG. 4B depicting a longitudinal section of an embodiment of an NGT of the invention, having a main lumen and one vacuum lumen comprising a suction unit (or suction port). For simplicity of discussion, only one suction port is shown while it should be appreciated that more than one suction port may be included. FIG. 4B further depicts a tissue, e.g., esophagus tissue, being pulled in by the applied vacuum force. It will be appreciated by a person skilled in the art that in order to couple the tissue to the tube, the tissue should reach the lumen base. Nevertheless, clinical trials have shown tissue damage in cases when the applied vacuum sucked the tissue into the vacuum lumen (i.e., beyond the suction port). Thus, the NGT described herein provides specific and unique structure of one or more suction ports and/or of the vacuum lumen which substantially prevent tissue damage.

In some embodiments, a nasogastric tube of the invention comprises at least one vacuum lumen comprising at least one suction port for sealingly drawing an inner wall of an esophagus thereagainst, said at least one suction port has a concavity whose longitudinal cross-section has a shape delimited between (i) a first arc of a first circle, the first arc having a length of 25 millimeters and a height of 1.5 millimeters, and (ii) a second arc of a second circle, the second arc having a length of 15 millimeters and a height of 1 millimeter.

Reference is now made to FIG. 4A. FIG. 4A is a simplified, schematic illustration of a side view of a portion of a nasogastric tube, constructed and operative in accordance with a non-limiting embodiment of the present invention. Nasogastric tube 10 is generally similar to nasogastric tube 10 of FIG. 1 as detailed hereinbelow, and for simplicity only one suction port 26 is shown. Nasogastric tube 10 comprises suction port(s) 26 having a concavity whose longitudinal cross-section has a shape delimited between a first arc of a first circle 27*a* and a second arc of a second circle 27*b*.

In some embodiments, the first arc of a first circle has a length of 25 millimeters and a height of 1.5 millimeters. In some embodiments, said first arc of a first circle has a length of 24 millimeters, 23 millimeters, 22 millimeters or 21 millimeters and a height of 1.5 millimeters. In another embodiment, said first arc of a first circle has a length of 25 millimeters, 24 millimeters, 23 millimeters, 22 millimeters or 21 millimeters and a height of 1.4 millimeters. In another embodiment, said first arc of a first circle has a length of 25 millimeters, 24 millimeters, 23 millimeters, 22 millimeters or 21 millimeters and a height of 1.3 millimeters. In another embodiment, said first arc of a first circle has a length of 25 millimeters, 24 millimeters, 23 millimeters, 22 millimeters or 21 millimeters and a height of 1 millimeters.

In another embodiment, the second arc of a second circle has a length of 15 millimeters and a height of 1 millimeter. In another embodiment, said second arc of a second circle has a length of 15 millimeters, 16 millimeters, 17 millimeters, 18 millimeters, 19 millimeters or 20 millimeters and a height of 1 millimeters. In another embodiment, said second arc of a second circle has a length of 15 millimeters, 16 millimeters, 17 millimeters, 18 millimeters, 19 millimeters or 20 millimeters and a height of 1.1 millimeters. In another embodiment, said second arc of a second circle has a length of 15 millimeters, 16 millimeters, 17 millimeters, 18 millimeters, 19 millimeters or 20 millimeters and a height of 1.2 millimeters.

In another embodiment, the at least one suction port 26 has a concavity having an arc having a length of 18 mm, 19 mm, 20 mm, 21 mm or 22 mm, wherein each possibility represents a separate embodiment of the present invention. In exemplary embodiments, said arc has a length between 20 mm-21 mm, 20.1 mm, 20.3 mm or approximately 20.12 mm.

Said concavity of said suction port may alternatively be defined by a height Hs and Ls as depicted in FIG. 4A. In some embodiments, the one or more suction ports have a maximum concavity Hs of 1.5 mm as measured over a length Ls of 20 mm. In some embodiments, the one or more suction ports have a maximum concavity Hs of 1.4 mm as measured over a length Ls of 20 mm. In some embodiments, the one or more suction ports have a maximum concavity Hs of 1.3 mm as measured over a length Ls of 20 mm. In some embodiments, the one or more suction ports have a maximum concavity Hs of 1.2 mm as measured over a length Ls of 20 mm. In another embodiment, said length Ls is 18 mm, 19 mm, 20 mm, 21 mm or 22 mm, wherein each possibility represents a separate embodiment of the present invention.

Figure 2:
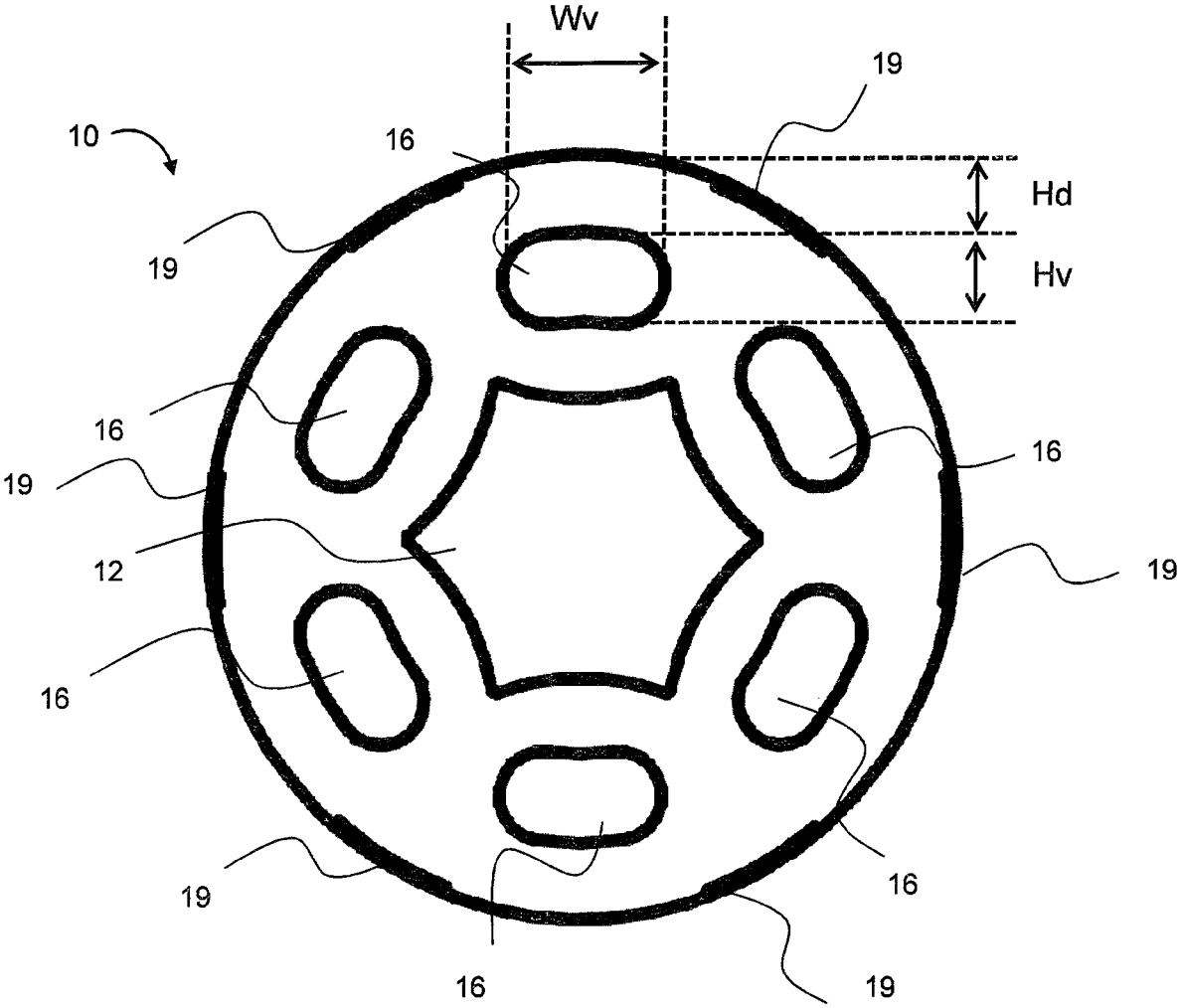
FIG. 2 is a simplified sectional illustration of the NGT of FIG. 1, taken along lines II-II in FIG. 1.

Reference is now made to FIG. 2, which illustrate a nasogastric tube 10, constructed and operative in accordance with a non-limiting embodiment of the present invention. In one embodiment, illustrated in FIG. 2, there are six vacuum lumens 16 peripherally spaced around main lumen 12; the invention is not limited to this number of vacuum lumens. The vacuum lumens 16 may be equally or unequally spaced from each other. Main lumen 12 and vacuum lumens 16 are thus arranged as concentrically arranged conduits. Each vacuum lumen may be defined by a height Hv and width Ws, as illustrated by FIG. 2.

In some embodiments, a nasogastric tube of the invention comprises at least one vacuum lumen comprising at least one suction port for sealingly drawing an inner wall of an esophagus thereagainst, said at least one vacuum lumen has a width (Ws)-height (Hs) aspect ratio of 1:1 to 3:1. In another embodiment, said width (Ws)-height (Hs) aspect ratio of the vacuum lumen is at least 1:1 or at least 2:1. In another embodiment, said width (Ws)-height (Hs) aspect ratio of the vacuum lumen is at most 4:1 or at most 3:1.

In another embodiment, said one or more vacuum lumen(s) have a height Hs of 0.3-0.8 mm. In another embodiment, said one or more vacuum lumen(s) has a height Hs of at most 1, at most 0.9 mm, at most 0.8 mm, at most 0.75 mm or at most 0.7 mm. In another embodiment, said one or more vacuum lumen(s) has a height Hs of at least 0.3, at least 0.4, at least 0.5 mm, at least 0.6 mm, at least 0.65 or at least 0.7 mm.

In another embodiment, said one or more vacuum lumens have a width Ws of at most 4 mm, at most 3 mm, at most 2.5 mm, at most 2 mm, at most 1.9 mm, at most 1.8 mm, at most 1.7 mm, at most 1.6 mm, at most 1.5 mm or at most 1.5 mm. In another embodiment, said one or more vacuum lumens have a width Ws of at most 1.5 mm. In another embodiment, said one or more vacuum lumens have a width Ws of at least 0.5 mm, at least 0.6 mm, at least 0.7 mm, at least 0.8, at least 0.9, at least 1 mm, at least 1.1 mm, at least 1.2 mm or at least 1.3 mm.

In another embodiment, distance Hd, as illustrated in FIG. 2, between the perimeter of said vacuum lumen 16 and perimeter of said NGT 10 is between 0.2 mm-1 mm, between 0.3 mm-0.9 mm, between 0.4 mm-0.8 mm, between 0.5 mm-0.7 mm. In another embodiment, distance Hd is approximately 0.6 mm.

In some embodiments, a nasogastric tube of the invention comprising at least one vacuum lumen comprising at least one suction port for sealingly drawing an inner wall of an esophagus thereagainst. An NGT according to the present invention can be used in ICU, or elsewhere, in order to reduce the complications associated with reflux such as the risk of VAP and in order to prevent or reduce tissue damage.

In some embodiments, a tube according to the present invention may be used in other locations in the GI tract or in any other body lumen, such as arteries, veins, etc. However, for simplicity of discussion, this tube is referred to throughout the specification as an NGT.

In some embodiments, the structure of an NGT according to the present invention enables locally selective application of the vacuum within the esophagus. In some embodiments, the location of the esophagus coupling to the tube may be changed in time in order to diminish tissue damage to the esophagus.

Reference is now made to FIGS. 1 and 2, which illustrate a nasogastric tube 10, constructed and operative in accordance with a non-limiting embodiment of the present invention.

NGT 10 includes a main (typically, but not necessarily, central) lumen 12. Main lumen 12 may be used to feed and administer drugs and other oral agents, and may also be used for sucking fluids from the stomach. As such, as is known in the art, main lumen 12 may be a double lumen, one lumen for feeding and the other lumen for suction (not to be confused with the vacuum lumens mentioned later). Main lumen 12 is provided with one or more suitable proximal connectors 14 for connecting to a source of substances for feeding or administering, and optionally to a source of pressure (e.g., suction), as is known in the art.

NGT 10 includes one or more vacuum lumens 16 that peripherally surround main lumen 12. The term "peripherally surround" as used in the description and claims, encompasses continuous surrounding (no gaps between the vacuum lumens or one continuous, peripheral vacuum lumen) and discontinuous surrounding (wherein there are separations between discrete vacuum lumens). Vacuum lumens 16 are coupled with a vacuum source 18, such as via a pressure regulator 20 and a valve 22, which form a vacuum control unit.

Main lumen 12 may be constructed from any suitable biocompatible material, such as but not limited to, polyurethane, silicone, polyvinyl chloride and many others. The vacuum lumens 16 may be constructed of similar materials, but alternatively may be constructed of medically safe metals, such as but not limited to, stainless steel, titanium alloys, NITINOL and others. Generally, without limitation, main lumen 12 may have a length in the range of 50 to 130 cm, with an outside diameter in the range of 5-12 Fr.

Main lumen 12 and vacuum lumens 16 may be constructed as one unit. Alternatively, vacuum lumens 16 may form a separate unit which is slid over main lumen 12 after insertion of main lumen 12 into the patient body. As another alternative, vacuum lumens 16 may be first introduced into the patient, and main lumen 12 may be slid in between vacuum lumens 16.

Figure 3:
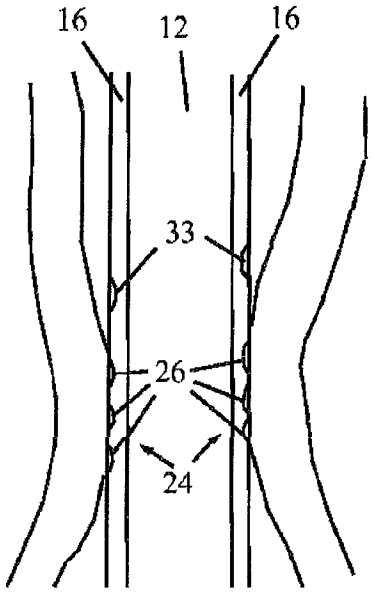
FIG. 3 is a simplified schematic illustration of the nasogastric tube being used to suck and seal the inner wall of the esophagus against the NGT, in accordance with an embodiment of the present invention.

With reference to FIG. 1, each vacuum lumen 16 includes a vacuum sealing portion 24, which includes one or more suction ports 26. As shown in FIG. 1, some vacuum lumens 16 may have more suction ports than others. As shown in FIG. 3, upon application of vacuum generated by vacuum source 18, the inner wall of the esophagus is drawn by negative pressure towards and against suction ports 26 (the outer contour of NGT 10). The outer contour of NGT 10, at least at vacuum sealing portion 24, is preferably round (circular or oval), for better conforming to and sealing of the esophagus. In one embodiment, the vacuum sealing restricts at least 60% of the passage through the esophagus.

Pressure regulator 20 may be used to reduce or otherwise regulate the negative pressure generated by vacuum source 18. For example, pressure regulator 20 may be used to match the vacuum level generated by vacuum source 18 to the vacuum level needed in vacuum sealing portion 24. Such vacuum pressure may be, for example, between 0.5-50, 50-100, 100-200, 200-300, 300-400, 400-500, 500-600 or 600-760 mmHg. Different vacuum pressure values may be suitable to different patients and/or to different luminal structures into which the tube of the present invention is inserted.

Valve 22 may be used to shift the vacuum between the different vacuum lumens 16 so that the suction level is not constant over time in the vacuum sealing portion 24, which may provide variability in how the esophagus wall is sucked in, and for how long.

NGT 10 may be provided with different numbers of vacuum sealing portions 24 and suction ports 26, and the vacuum to the sealing portions 24 may be regulated so as to create peristaltic movement or other oscillatory movement of the esophagus.

In accordance with an embodiment of the invention, one or more auxiliary suction ports 33 are provided proximal to vacuum sealing portion 24. Since vacuum sealing portion 24 seals off the esophagus, any oropharyngeal secretions, such as saliva, may accumulate above (i.e., proximal to) vacuum sealing portion 24. Auxiliary suction ports 33 may be used to suck and remove such secretions. Additionally or alternatively, one or more of vacuum lumens 16 may be used to evacuate liquids arriving from the patient's stomach. That is, if a reflux occurs, one or more of vacuum lumens 16 may withdraw at least a portion of it, through suction ports 26, towards valve 22. There, the stomach contents may be collected inside a suitable reservoir and then discarded.

Vacuum source 18 is preferably activated following the insertion and localization of NGT 10 in the esophagus in order to reduce the risk of VAP, or other bacterial infections, by preventing or minimizing reflux food and liquid aspiration into the lungs.

Reference is made to FIG. 4B depicting a transparent longitudinal section of an embodiment of an NGT of the invention. NGT 10 comprises a main lumen 12 and one or more vacuum lumen(s) 16 comprising a suction port. When negative pressure is applied (i.e. vacuum), tissue 60 (e.g., esophagus tissue), is pulled in to the suction port. FIG. 4B shows as a non-limiting embodiment a cause for issue damage in cases when the applied vacuum sucks the tissue into the vacuum lumen 16 (i.e., beyond the suction port). In some embodiments, the NGT described herein provides specific and unique structure of one or more suction ports and/or of the vacuum lumen 26 which substantially prevent drawing of tissue in to the vacuum lumen 16 and thus prevent tissue damage.

Suction ports 26 are in some embodiments substantially rectangular shaped, such as rectangular with rounded corners as depicted in FIG. 2. In other embodiments, suction ports 26 are elliptical or circular.

In some embodiments, at least one suction port 26 may include two or more suction ports, successively arranged along a portion of a longitudinal axis of nasogastric tube 10.

Figure 5:
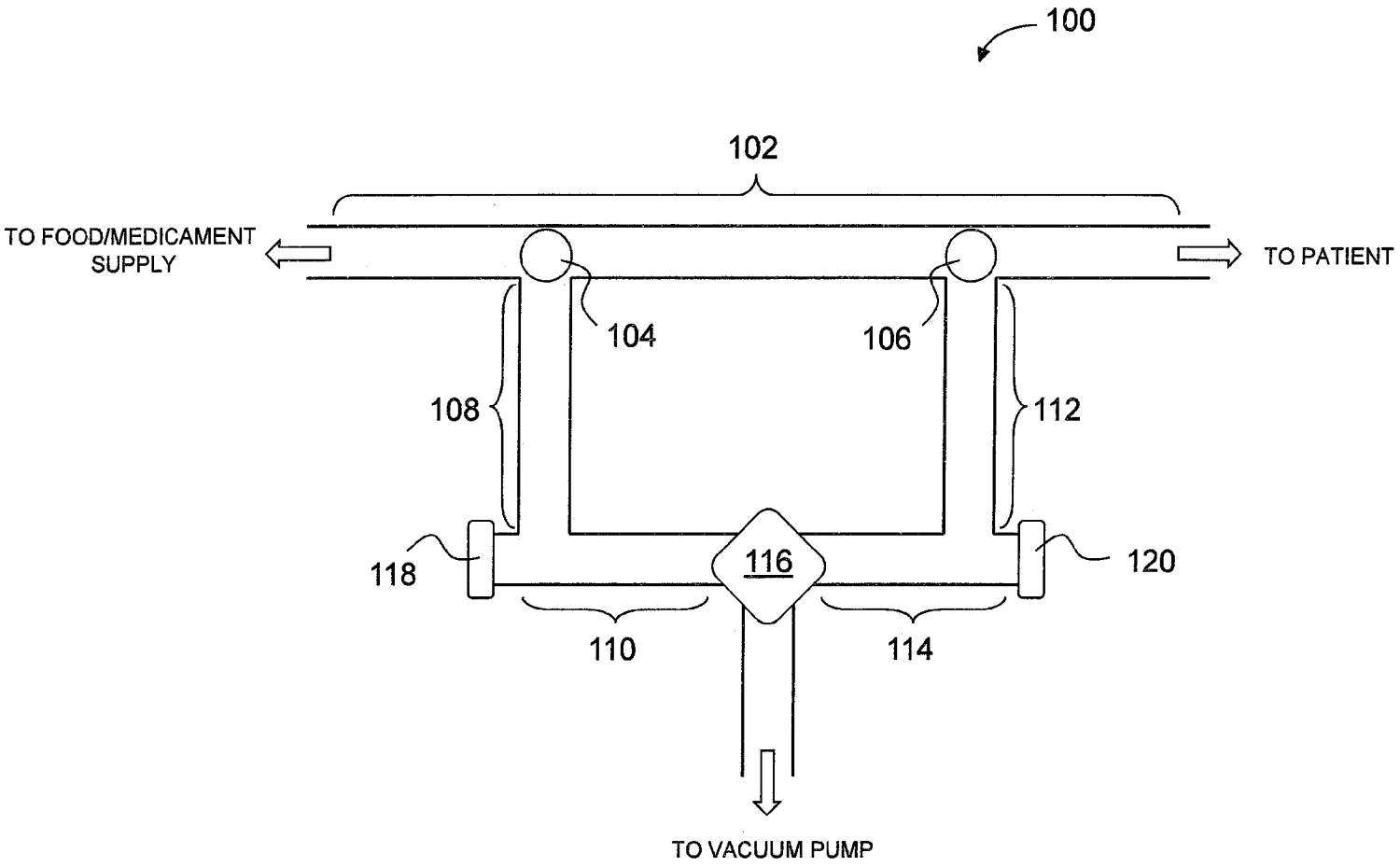
FIG. 5 is a schematic diagram of a manifold.

Reference is now made to FIG. 5, which shows a schematic diagram of a manifold 100, which, in accordance with some embodiments, serves as valve 22 of FIG. 1. Manifold 100 may be used to interconnect tubes extending between the patient, the food and/or medicament supply, and the vacuum source (e.g. a vacuum pump).

A main tube 102 may extend between the patient and the food and/or medicament supply. Main tube 102 may include, at manifold 100, two or more junctions 104 and 106. Junctions 104 and 106 may be used for alternating between different vacuum lumens or groups of vacuum lumens. That is, each of junctions 104 and 106 may interconnect different vacuum lumens or groups of vacuum lumens to the vacuum source. Junction 104, for example, may be connected to the vacuum source via a first tube (represented by tube portions 108 and 110). Junction 106, for example, may be connected to the vacuum source via a second tube (represented by tube portions 112 and 114). Tube portions 110 and 114 may be connected to the vacuum source through a selector 100. Selector 116 may have two possible states: In the first state, negative pressure from the vacuum source is channeled towards portion 110 and from there to junction 104. In the second state, negative pressure from the vacuum source is channeled towards portion 114 and from there to junction 106. In embodiments where more than two junctions are present (not shown), a selector may have a number of states corresponding to the number of junctions.

Optionally, manifold 100 may include one or more vacuum discharge ports, for releasing negative pressure from a certain vacuum lumen or a group of vacuum lumens after the negative pressure has been switched away from this lumen or group of vacuum lumens by selector 116. Two exemplary vacuum discharge ports 118 and 120 are shown in the figure. Optionally, the vacuum discharge ports 118 and 120 may each be a cap threadable at some point between selector 116 and junctions 104 and 106, respectively. After the caregiver has switched the vacuum from a first vacuum lumen (or a first group of lumens) to a second vacuum lumen (or a second group of lumens), he or she may use the suitable one of vacuum discharge ports 118 and 120 in order to immediately discharge the negative pressure from the first vacuum lumen (or the first group of lumens). This way, the inner wall of the esophagus, at the vacuum port(s) connected to the first vacuum lumen (or the first group of lumens), may be immediately released from the vacuum port(s) and tissue damage may be prevented or at least mitigated.

One method of using NGT 10 of the present invention includes the following steps, without limitation and not necessarily in sequential order:

a) introducing NGT 10 into the esophagus of the subject;

b) applying vacuum to one or more of the vacuum sealing portion(s) 24;

c) adjusting the vacuum level (which may be done before step a);

d) after achieving a desired sealing of the esophagus wall to NGT 10, changing the vacuum intervals between the vacuum lumens 16, manually or automatically, such that NGT 10 remains intact to the esophagus; and (e) applying, manually or automatically, vacuum to one or more of vacuum lumen 16 which include decompression port(s) 23.

In additional embodiments, said nasogastric tube has a length, and each of said plurality of suction ports is associated with a different one of said plurality of vacuum lumens, wherein said plurality of ports are distributed between at least two different locations along the length of said nasogastric tube. Distributing suction ports along the length of said nasogastric tube enables locally selective application of the vacuum within the esophagus. Thus, the location of the esophagus coupling to the tube may be changed in time in order to diminish tissue damage to the esophagus.

Figures 6A, 6B, 6C:
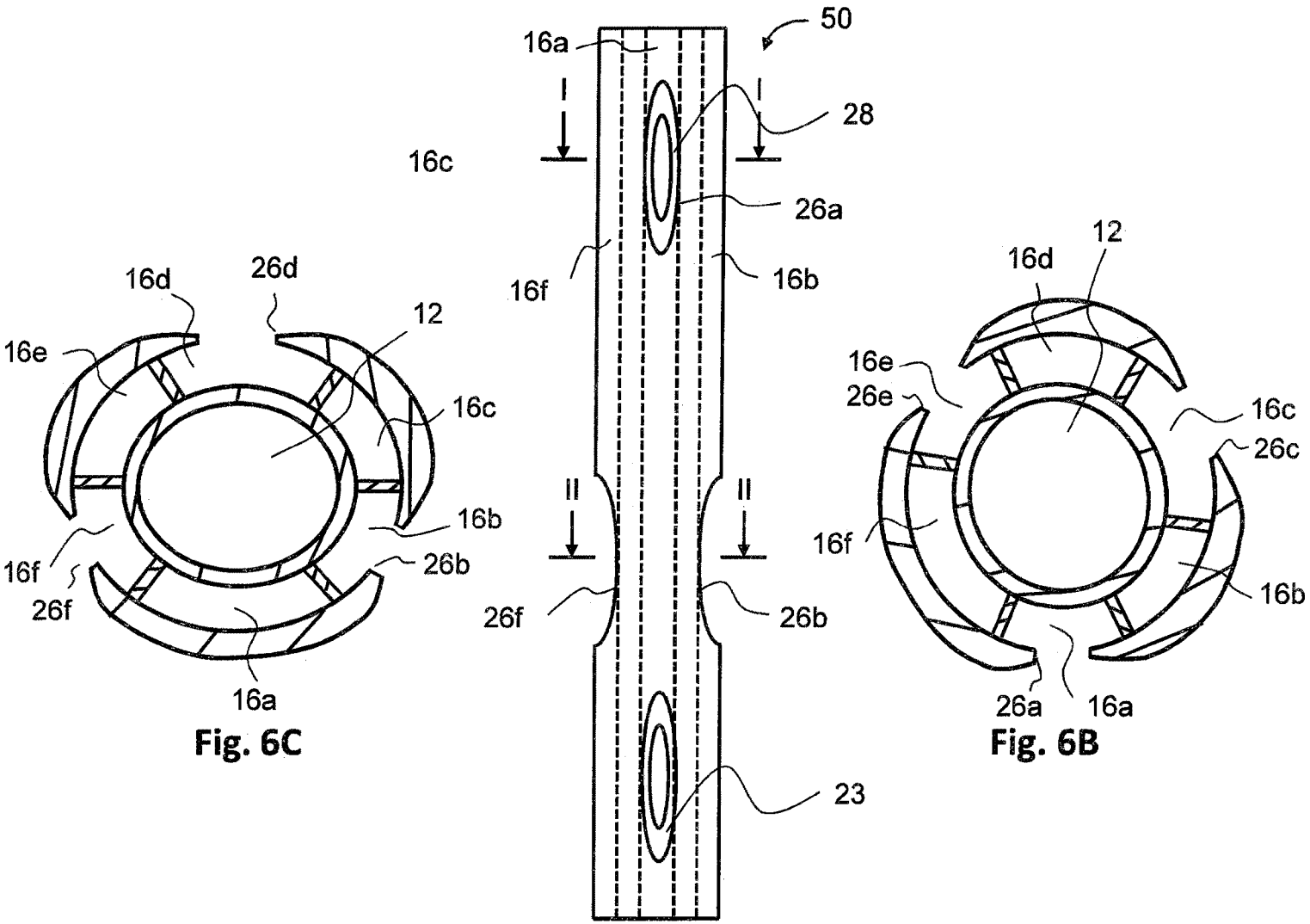
FIG. 6A is a simplified, schematic illustration of a transparent front view of a portion of a nasogastric tube, constructed and operative in accordance with another embodiment of the present invention.
FIG. 6B is a simplified schematic illustration of a cross-section along line I-I of the nasogastric tube of FIG. 6A.
FIG. 6C is a simplified schematic illustration of a cross-section along line II-II of the nasogastric tube of FIG. 6A.

Reference is now made to FIGS. 6A, 6B and 6C. FIG. 6A is a simplified, schematic illustration of a transparent front view of a portion of a nasogastric tube 50, constructed and operative in accordance with another non-limiting embodiment of the present invention. FIG. 6B is a simplified schematic illustration of a cross-section along line I-I of nasogastric tube 50 of FIG. 6A. FIG. 6C is a simplified schematic illustration of a cross-section along line II-II of nasogastric tube 50 of FIG. 6A. Nasogastric tube 50 is generally similar to nasogastric tube 10 of FIG. 1. The differences between nasogastric tube 10 and nasogastric tube 50 are detailed herein below. FIG. 6A shows a proximal portion of nasogastric tube 50 to be inserted into a patient's esophagus and with respect to it. Nasogastric tube 50 includes an additional upper portion, which is not shown, that is left outside of the patient's body and is coupled with, for example, vacuum source 18, pressure regulator 20 or valve 22. Nasogastric tube 50 includes main lumen 12 and six vacuum lumens 16, specifically denoted 16*a*, 16*b*, 16*c*, 16*d*, 16*e* and 16*f*. However, in other embodiments (not shown), a different number of vacuum lumens, such as four or more, may be used. Nasogastric tube 50 further includes a decompression port(s) 23 located distal to the longitudinal location of suction ports 26*b*, and 26*f*, as shown in FIG. 6A. Decompression port(s) 23 are, in some embodiments, configured to be positioned inside a stomach or a duodenum.

Each vacuum lumen 16 includes a suction port 26, specifically denoted 26*a*, 26*b*, 26*c*, 26*d*, 26*e* and 26*f* correspondingly. Therefore, each of suction ports 26 is associated with one of lumens 16. Suction ports 26*a*, 26*b*, 26*c*, 26*d*, 26*e* and 26*f* are distributed along a longitudinal axis of nasogastric tube 50. Suction ports 26*a*, 26*c* and 26*e* are located above suction ports 26*b*, 26*d* and 26*f* along the longitudinal axis of nasogastric tube 50 and with respect to a patient's body. Such a longitudinal axis may be advantageously located within main lumen 12.

With specific reference to FIGS. 6B and 6C, FIG. 6B shows a cross-section of suction ports 26*a*, 26*c* and 26*e*. Suction ports 26*a*, 26*c* and 26*e* are peripherally distributed around main lumen 12 in the same longitudinal location with respect to main lumen 12 (i.e., along a longitudinal axis of nasogastric tube 50). FIG. 6C shows a cross-section of suction ports 26*b*, 26*d* and 26*f*. Suction ports 26*b*, 26*d* and 26*f* are peripherally distributed around main lumen 12 in the same longitudinal location with respect to main lumen 12, as shown in FIG. 6A. The longitudinal location of suction ports 26*a*, 26*c* and 26*e* is different from and located above the longitudinal location of suction ports 26*b*, 26*d* and 26*f*, as shown in FIG. 6A. Generally, without limitation, the distance between suction ports 26*a*, 26*c* and 26*e* and 26*b*, 26*d* and 26*f* is in the range of 50 to 250 mm, or 100 to 150 mm.

Therefore, for example, applying vacuum to vacuum lumens 16*a* or 16*c* or 16*e* or to any combination thereof, allows sealing of the esophagus against nasogastric tube 50 in different peripheral locations (i.e., depending on the vacuum lumens which are used) and in different levels (i.e., depending on how many vacuum lumen are used) but in a specific longitudinal location (denoted by line I-I with respect to nasogastric tube 50 in FIG. 6A). In order to allow maximal sealing of the esophagus, vacuum may be applied to vacuum lumens 16*a*, 16*c* and 16*e* together at the same time. Applying vacuum to vacuum lumens 16*b* or 16*d* or 16*f* or to a combination thereof, would result the same correspondingly but in different peripheral locations with respect to main lumen 12 (i.e., according to the peripheral locations of vacuum lumens 16*b*, 16*d* or 160 and in particular, in a different longitudinal location along nasogastric tube 50, denoted by line II-II in FIG. 6A. Vacuum may be also applied to vacuum lumens located in different longitudinal locations along nasogastric tube 50 at the same time.

Hence, the location of the vacuum lumens within the nasogastric tube according to the present invention determines the peripheral location of the applied vacuum and the location of the suction ports determines the longitudinal location of the applied vacuum within the esophagus: It should be noted that the positioning of nasogastric tube 50 within the esophagus as performed by the attending caregiver should be also considered. Switching the applied vacuum between the vacuum lumens allows applying vacuum on the esophagus inner wall at different locations peripherally and longitudinally during time, thus diminishing or preventing damage to the esophagus tissue facing the suction ports.

Valve 22 may be used to switch the vacuum between one or more vacuum lumens 16. Valve 22 may be separately connected to each vacuum lumen 16 or, for example, connected to all of vacuum lumens 16 having suction ports 26 at the same longitudinal location with respect to nasogastric tube 50 together. Obviously, the latter setup of valve 22 allows less freedom in switching between vacuum lumens 16. Hence, valve 22 may be used to switch the applied vacuum after a time duration from one or more vacuum lumens located at specific peripheral and longitudinal locations to one or more vacuum lumens located at other peripheral locations or furthermore at other longitudinal locations. Such a switch may be performed gradually in order to keep the esophagus sealed at least to some extent against nasogastric tube 50 during the switch.

Nasogastric tube 50 may include two or more vacuum lumens 16 which peripherally surround main lumen 12. At least two of vacuum ports 26 are located at different longitudinal locations along nasogastric tube 50 in order to allow a longitudinal location switch within the esophagus.

Suction ports 26 are elliptical but may be of any other form, such as circular. Suction ports 26 may include a graduated edging 28 to prevent or diminish damage to the esophagus tissue while an inner wall of the esophagus is pressed against suction ports 26. Graduated edging 28 is advantageously graduated in an obtuse angle. Graduated edging 28 may be graduated entirely or only include a graduated portion. Generally, graduated edging 28 may provide each of suction ports 26 with a concave shape, having an opening approximately in its middle.

Nasogastric tube 50 may be coupled with a manifold (not shown). The manifold may connect vacuum lumens 16 to valve 22 in a separate manner to allow vacuum application to one or more vacuum lumens 16. The manifold may be transparent in order to visually monitor backflow of gastric substances, such as bile.

In some embodiments, at least one suction port 26 may include two or more suction ports, successively arranged along a portion of a longitudinal axis of nasogastric tube 50.

Gastric Decompression

According to some embodiments, the NGT of the present invention is configured to perform as a feeding tube as well as a gastric decompression tube. Thus, the NGT enables administration of nutrients or drugs directly to a subject's stomach or intestines and simultaneously or interchangeably enables gastric decompression. In accordance with an embodiment, the invention provides a system comprising an NGT comprising a feeding mechanism, a suction mechanism configured to sealingly draw an inner wall of an esophagus thereagainst, and a gastric decompression mechanism.

In some embodiments, the gastric decompression mechanism comprises at least one gastric decompression port associated with at least one of said plurality of vacuum lumens, said at least one gastric decompression port being disposed distally to the at least two different locations along the length of said nasogastric tube. In another embodiment, the gastric decompression mechanism comprises at least at least one gastric decompression port associated with an additional at least one vacuum lumen, said at least one gastric decompression port being disposed distally to the at least two different locations along the length of said nasogastric tube. NGTs comprising gastric decompression mechanism and method for use of said NGTs are disclosed in PCT/IL2014/050576, the contents of which are incorporated herein by reference at their entirety.

In some embodiments, the suction mechanism is further configured to aspirate fluids from the esophagus. The suction mechanism and the gastric decompression mechanism are, in some embodiments, disposed (situated) and associated by one or more same lumens. In other embodiments, the suction mechanism and the gastric decompression mechanism are configured to perform by independent lumens.

According to some embodiments, the peripheral (vacuum) lumens are configured to aspirate fluids such as gastric reflux from the esophagus. In some embodiments, said at least one suction port is configured to aspirate fluids from the esophagus. By virtue of applying vacuum to the peripheral lumens of the NGT described herein, the at least one suction port is used for sealingly drawing an inner wall of an esophagus thereagainst and interchangeably or simultaneously aspirate fluids from the esophagus. One skilled in the art will is well capable of determining the vacuum pressure to be applied for sealing the esophagus and/or aspirating fluids from the esophagus.

Figure 7A:
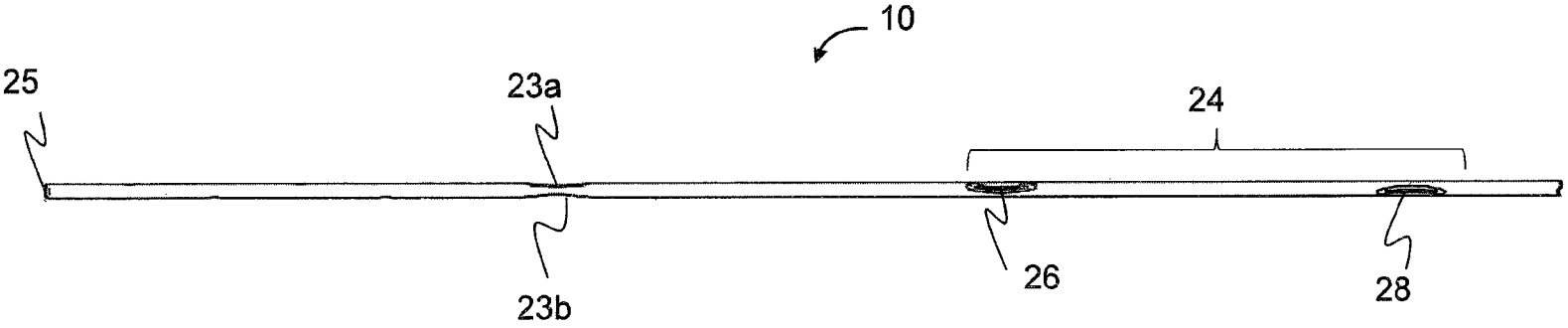
FIG. 7A is a simplified, schematic illustration of a portion of a nasogastric tube in accordance with a non-limiting embodiment of the present invention.
Figure 7B:
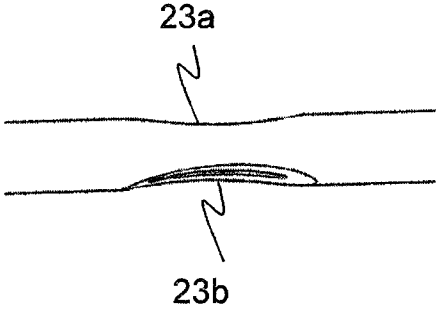
FIG. 7B is a simplified enlarged illustration of a portion of the nasogastric tube comprising the decompression ports, in accordance with a non-limiting embodiment of the present invention.

Reference is now made to FIGS. 7A and 7B. FIG. 7A illustrates a simplified, schematic illustration of a portion of an NGT 10, constructed and operative in accordance with a non-limiting embodiment of the present invention. FIG. 7B is a simplified and enlarged illustration of a distal portion of the NGT comprising one or more gastric decompression ports. NGT 10 includes, for example, a vacuum sealing portion 24 comprising two suction ports 28 and 26 distributed between two different locations along the length of NGT 10. NGT 10 further includes one or more gastric decompression ports 23*a* and 23*b* disposed distally to the vacuum sealing portion 24. Typically, the one or more gastric decompression ports 23*a* and 23*b* are configured to be positioned inside a stomach and/or a proximal duodenum.

Generally, without limitation, the distance between one or more gastric decompression ports 23 to at least one suction port is in the range of 50 to 200 mm.

The one or more gastric decompression port(s) 23 is associated with at least one of vacuum lumen 16 (not shown). In some embodiments, the one or more gastric decompression port(s) 23 is associated with a vacuum lumen 16 which comprises one or more suction ports 26. In other embodiments, the one or more gastric decompression port(s) 23 is associated with at least one additional vacuum lumen 16 (such as a vacuum lumen 16 devoid of suction ports 26). Gastric decompression port(s) 23 may be configured to be positioned inside a stomach. Gastric decompression port(s) 23, in another embodiment, may be configured to be positioned inside a proximal duodenum. Gastric decompression port 23 is, in some embodiments, disposed distally to vacuum sealing portion 24 (and suction ports 28 and 26). Decompression port(s) 23 may be elliptical or of any other form, such as circular.

NGT 10 further includes one or more feeding port 25 at the distal end of main lumen 12. In additional embodiments, such as for simultaneous feeding and decompression, the one or more feeding ports 25 are distal to the one or more gastric decompression ports 23. Feeding port 25 may be configured to be positioned in the stomach or in the duodenum. Generally, without limitation, the distance between one or more gastric decompression ports 23 to at least one feeding port is in the range of 50 to 300 mm, or in the range of 100 to 200 mm.

In one embodiment, the one or more gastric decompression port(s) 23 are configured to be positioned in a position selected from a distal esophagus (i.e., distal to vacuum sealing portion 24), inside a stomach, proximal duodenum, or a combination thereof. In embodiments wherein gastric decompression port(s) 23 are configured to be positioned in the proximal duodenum, feeding port 25 may be configured to be positioned in a distal duodenum.

Vacuum lumen 16 comprising a decompression port 23 may be constructed of similar materials to vacuum lumen 16 comprising suction ports 26, but alternatively may be constructed of medically safe metals, such as but not limited to, stainless steel, titanium alloys, NITINOL and others.

As known to one skilled in the art, the system described herein may further comprise a guiding probe (e.g., a stylet) for inserting the NGT to a subject. Said guiding probe is typically is removed after confirming the correct placement of the NGT.

A method of using NGT 10 of the present invention may include the following steps, without limitation and not necessarily in sequential order:

a) introducing the NGT into an esophagus of a patient; and b) applying vacuum to one or more suction ports so as to sealingly draw an inner wall of the esophagus thereagainst each time in a different location along the esophagus.

In some embodiments, said vacuum is applied to one or more suction ports interchangeably between the differently located suction ports so as to sealingly draw an inner wall of the esophagus thereagainst each time in a different location along the esophagus. The vacuum may be applied to one or more vacuum lumens each time, and in each time to vacuum lumens which include suction ports peripherally distributed around the same location along a longitudinal axis of the NGT or peripherally distributed around different locations along a longitudinal axis of the NGT. The interchanging between the vacuum lumens to which a vacuum is applied may be performed at various manners, for example, it may be performed once or more per patient while each location change may be performed once in a constant or variable period of time, all according to the caregiver discretion regarding the specific patient.

The method may further include the step of regulating the vacuum so that a suction level is not constant over time in the suction ports. The vacuum may be regulated to the vacuum ports so as to create peristaltic movement or other oscillatory movement of the esophagus.

In some embodiments, the vacuum may be applied such that to restricts at least 60% of passage through the esophagus.

Nasogastric tube 10 may be coupled with a manifold (not shown). The manifold may connect vacuum lumens 16 to valve 22 in a separate manner to allow vacuum application to one or more vacuum lumens 16. The manifold may be transparent in order to visually monitor backflow of gastric substances, such as bile.

The method may further include the step of visually monitoring a transparent manifold which couples the vacuum lumens with a valve for backflow of gastric substances, such as bile.

In some embodiments of the present invention, the present invention may be utilized to insert one or more probes through main lumen 12, through one or more of vacuum lumens 16 and/or through a different, dedicated lumen (not shown) into the patient's body. Such probes may include, for example: a temperature sensor, an electromagnetic radiation sensor, a pH sensor, an image sensor, a fiber optic, an ultrasound probe, an OCT (optical coherence tomography) probe, a mini MRI (magnetic resonance imaging) probe, etc.

The NGT may include one or more radiopaque stripes 19 disposed along the longitudinal axis of the tube. Radiopaque stripes may be visible, when tube (or a portion thereof) is inside the patient, using X-ray imaging and/or other types of electromagnetic radiation imaging. That is, radiopaque stripes are made of a radiodense material which inhibits the passage of some or all electromagnetic radiation, thereby creating a contrast in relation to more radiolucent body tissue and/or radiolucent portions of a medical device. Generally, if two or more parallel, longitudinal radiopaque stripes are present, the resulting electromagnetic radiation image may enable a better depth perception of the tube. This, since one or more of the stripes may be farther away from the imager than other one or more of the stripes. Furthermore, having two or more parallel, longitudinal radiopaque stripes may enable visualizing a situation in which the tube is twisted; this will result in a spiral-like image of the stripes. An example of a suitable radiodense material is Barium sulfate, but those of skill in the art will recognize that other known radiodense materials may be used. In case Barium sulfate is used, its density in stripes may be, for example, between 40-60%, between 60-80% or higher. The remainder percentage may be one or more filler materials.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A gastric tube comprising:

(a) main lumen having one or more proximal connectors for connecting to a source of substances or pressure;

(b) at least one vacuum lumen peripherally surrounding said main lumen, said at least one vacuum lumen comprises at least one suction port for sealingly drawing an inner wall of an esophagus thereagainst, said at least one suction port is positioned on a circumference extension of said main lumen, wherein each said at least one suction port has a graduated edging and a concavity whose longitudinal cross-section has a shape delimited between (i) a first arc of a first circle, the first arc having a length of 25 millimeters and a height of 1.5 millimeters, and (ii) a second arc of a second circle, the second arc having a length of 15 millimeters and a height of 1 millimeter, wherein, when in use and suction is applied, the inner wall of the esophagus is sealingly drawn into, but not beyond, the suction port while damage to esophageal tissue is diminished.

2. The gastric tube of claim 1, wherein said at least one vacuum lumen is substantially rectangular shaped.

3. The gastric tube of claim 1, wherein said at least one vacuum lumen has a width-height aspect ratio of 1:1 to 3:1.

4. The gastric tube of claim 1, wherein said at least one vacuum lumen has a height of 0.3-0.8 mm.

5. The gastric tube of claim 1, wherein said at least one vacuum lumen has a width of at most 1.5 mm.

6. A system comprising:

a gastric tube comprising:

(a) a main lumen having one or more proximal connectors for connecting to a source of substances or pressure;

(b) a plurality of vacuum lumens peripherally surrounding said main lumen; and (c) a plurality of suction ports for sealingly drawing an inner wall of an esophagus thereagainst, each of said plurality of suction port is associated with a different one of said plurality of vacuum lumens, wherein each of said plurality of suction ports has a graduated edging and a concavity whose longitudinal cross-section has a shape delimited between (i) a first arc of a first circle, the first arc having a length of 25 millimeters and a height of 1.5 millimeters, and (ii) a second arc of a second circle, the second arc having a length of 15 millimeters and a height of 1 millimeter; such that, when in use and suction applied, the inner wall of the esophagus is sealingly drawn into, but not beyond, the suction port while damage to esophageal tissue is diminished; and a vacuum source connected to said plurality of vacuum lumens.

7. The system of claim 6, wherein each of said plurality of vacuum lumens is substantially rectangular shaped.

8. The system of claim 6, wherein each of said plurality of vacuum lumens has a width-height aspect ratio of 1:1 to 3:1.

9. The system of claim 6, wherein each of said plurality of vacuum lumens has a height of 0.3-0.8 mm.

10. The system of claim 6, wherein each of said plurality of vacuum lumens has a width of at most 1.5 mm.

11. The system of claim 6, wherein said main lumen and said plurality of vacuum lumens are constructed as one unit.

12. The system of claim 6, wherein said main lumen and said plurality of vacuum lumens are arranged as concentrically arranged conduits.

13. The system of claim 6, wherein each of said plurality of suction ports is associated with a different one of said plurality of vacuum lumens, wherein said plurality of suction ports are distributed between at least two different locations along a longitudinal axis of said gastric tube.

14. The system of claim 6, further comprising a valve and a manifold configured to connect said plurality of vacuum lumens to said valve.

15. The system of claim 14, wherein said manifold is transparent.

16. The system of claim 6, wherein said plurality of vacuum lumens comprise at least four vacuum lumens.

17. The system of claim 6, wherein said plurality of vacuum lumens comprise at least six vacuum lumens.

18. The system of claim 6, wherein said gastric tube further comprises two or more longitudinal radiopaque stripes embedded in an outer wall of said gastric tube.

19. A method comprising:

introducing a gastric tube into an esophagus of a patient, said gastric tube comprising a main lumen having one or more proximal connectors for connecting to a source of substances or pressure, a plurality of vacuum lumens peripheral to said main lumen, and a plurality of suction ports, each suction port being associated with a different one of said a plurality of vacuum lumens, wherein each of said plurality of suction ports has a graduated edging and a concavity whose longitudinal cross-section has a shape delimited between (i) a first arc of a first circle, the first arc having a length of 25 millimeters and a height of 1.5 millimeters, and (ii) a second arc of a second circle, the second arc having a length of 15 millimeters and a height of 1 millimeter; such that, when in use and suction applied, the inner wall of the esophagus is sealingly drawn into, but not beyond, the suction port while damage to esophageal tissue is diminished; and applying vacuum interchangeably to said plurality of vacuum lumens so as to sealingly draw an inner wall of an esophagus thereagainst.

* * * * *